US006298788B1

(12) United States Patent
Woods et al.

(10) Patent No.: US 6,298,788 B1
(45) Date of Patent: Oct. 9, 2001

(54) NON-LETHAL MODULAR CROWD CONTROL MUNITION

(75) Inventors: John W. Woods, Franklin; Brian Edward Fuchs, Hackettstown, both of NJ (US); Gerard I. Gillen, Milford, PA (US); Gary G. Fairbanks, Odenton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/611,684

(22) Filed: Jul. 7, 2000

(51) Int. Cl.[7] ..... F42B 12/00; F42B 8/28
(52) U.S. Cl. ..... 102/502; 102/444; 102/447
(58) Field of Search ..... 102/502, 444, 102/447

(56) References Cited

U.S. PATENT DOCUMENTS 4,833,961 * 5/1989 Adini ..... 89/1.1
5,200,573 * 4/1993 Blood ..... 102/501
5,535,679 * 7/1996 Craddock ..... 102/494
5,610,359 * 3/1997 Spector et al. ..... 89/1.11

OTHER PUBLICATIONS

Vehicle Mounting System (VMS) for the Modular Crowd Control Munition (MCCM), Commerce Business Daily Issue of May 18, 1999.*
1998 Department of Defense Joint Non–Lethal Weapons Program Annual Report (Jan. 1999).*
1997—A Year in Review, Joint Non–Lethal Weapons Program, Department of Defense Annual Report.*
Field Manual 23–23 (Chapters 1–4), Antipersonnel Mine M18A1 and M18 (Claymore), Jan. 6, 1966, (chapter 2, Mar. 30, 1973).*

* cited by examiner

*Primary Examiner*—Charles T. Jordan
*Assistant Examiner*—Kimberly S Smith
(74) *Attorney, Agent, or Firm*—John F. Moran; Michael C. Sachs

(57) ABSTRACT

A modular crowd control munition 10 fires a large number of non-lethal soft pellets into a crowd 100 using an explosive charge. The munition 10 contains a pellet matrix 22 that houses the soft pellets 40, and uses a low energy explosive sheet material 50 at the back of the munition 10 to disperse the soft pellets 40. The munition 10 is used for close-in, "last resort", crowd control to replace the necessity of using deadly force.

19 Claims, 2 Drawing Sheets

NON-LETHAL MODULAR CROWD CONTROL MUNITION

Government Interest

The invention described herein may be manufactured, licensed, and used by or for the U.S. Government.

BACKGROUND OF THE INVENTION

1. Field of the Invention

The present invention relates to a device and method that use non-lethal force for crowd control. More particularly, multiple soft pellets are propelled into a crowd, in a non-lethal manner, to disrupt the organization of the crowd. Most particularly, the soft pellets are propelled into zones of the crowd, disrupting the self-sustaining momentum found within the crowd. The device and method are useful when fixed from a myriad of terrain or vehicle platforms.

2. Brief Description of the Related Art

Rioting and mass mob actions are encountered by military and police units during the performance of their duties. In both calculated and spontaneous actions, often crowds involved in rioting and mob actions direct their energies towards a particular person to harass, object to possess or location to occupy. The focus of a mob may include, for example, foods, medicines and other necessities during famine or other catastrophes, harassment of political persons during civil unrest, destruction or ransacking of buildings, and possession of weapons located within storage facilities. Mobs may also desire to occupy significant locations, such as parliamentarian offices, military compounds, federal building, embassies, and airports to disrupt operations and/or harm personnel staffing those facilities. When confronting the mob action, civil authorities are generally outnumbered by the mob members who have lost any sense of control, resulting in situations that force civil authorities to consider and possibly use deadly force to control a particular situation, resulting in serious injury or death of one or more individuals.

When possible, use of an effective amount of non-lethal force is desirable over the use of deadly force. Security force, however, may be confronted with uncontrollable crowds where current non-lethal method of deterrent are ineffective inhibiting crowd action. Known non-lethal devices generally are effective against individuals, but remain ineffective against large numbers of people, particularly at close range. Rubber bullets fired from a sidearms may incapacitate individuals within a crowd, while still not interrupting the momentum of the crowd. Water cannons may be used in crowd situations, but the use and implementation of the water cannons is cumbersome and restricted.

Accordingly, there is a need in the art for improvements for non-lethal crowd control. The present invention addresses this and other needs.

SUMMARY OF THE INVENTION

The present invention includes a non-lethal modular crowd control munition comprising a support having a front side and a back side defining a chamber therein, a pellet matrix fixed within the defined chamber, the pellet matrix having a substantially uniform thickness and containing a plurality of compartments with each compartment being substantially similar in shape and size with other compartments, a plurality of soft pellets fixed within the pellet matrix, wherein each compartment contains approximately an individual soft pellet therein and a low energy explosive sheet material located within the defined chamber and along the back side of the pellet matrix, the explosive sheet material having a thickness and composition sufficient to propel the plurality of soft pellets from the pellet matrix.

The present invention also includes a method for crowd control comprising the steps of providing a non-lethal modular crowd control munition having a support with a front side and a back side defining a chamber therein, a pellet matrix fixed within the defined chamber, the pellet matrix having a substantially uniform thickness and containing a plurality of compartments with each compartment being substantially similar in shape and size with other compartments, a plurality of soft pellets fixed within the pellet matrix, wherein each compartment contains approximately an individual soft pellet therein and a low energy explosive sheet material located within the defined chamber and along the back side of the pellet matrix, the explosive sheet material having a thickness and composition sufficient to propel the plurality of soft pellets from the pellet matrix, positioning the munition with the front side facing a crowd and detonating the low energy explosive, wherein the soft pellets are effectively propelled into the crowd.

The non-lethal modular crowd control munition, and method of crowd control using the munition, are used as a close-in deterrent to rioting persons that may be used prior to the decision to use deadly force. Generally, the use of the non-lethal modular crowd control munition is a last resort course of action in a situation that would otherwise require the use of deadly force. The non-lethal modular crowd control munition provides directional and zone area coverage against large crowds to disperse and interrupt the riot action without having to exercise a deadly force option.

DETAILED DESCRIPTION OF THE PREFERRED EMBODIMENT

The present invention includes a non-lethal crowd control device or munition, and method using the munition. The munition has a plurality of soft pellets uniformly fixed within a pellet matrix, with the pellet matrix positioned within a support. The soft pellets are propelled from the support on detonation of an explosive sheet material fixed to the back of the support. The structural parts of the crowd control munition are purposely configured to minimize injury or death of individuals in the vicinity of the crowd control device during detonation of the explosive sheet material.

Use of the crowd control device is limited to "close-in", i.e., from about 45 feet or less, situations where the individuals within the crowd are endangering the safety or lives of other individuals, such as police officers, military troops, relief workers or other such persons. The wide dispersion of pellets into a focused area of the crowd disrupts the "momentum" of the crowd, ie., the coherency of the crowd action is defeated, allowing individuals both inside and outside of the crowd to extricate themselves from the mob action or riotous conduct.

Figure 1:
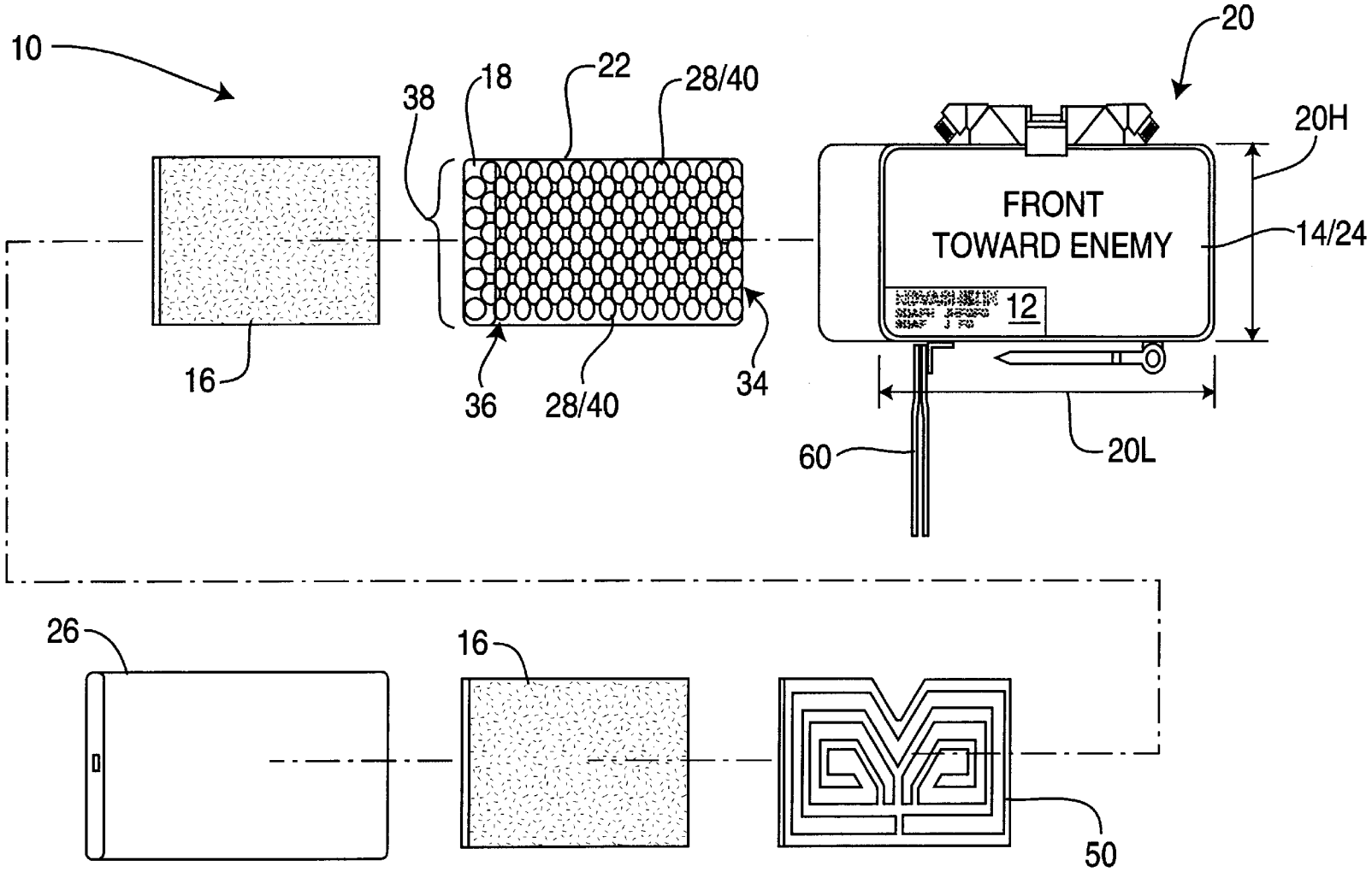
FIG. 1 illustrates a front exploded view of the non-lethal modular crowd control munition of the present invention; and, FIG. 2 shows the non-lethal modular crowd control munition of FIG. 1 in use fixed to a vehicle.

As shown in FIG. 1, a non-lethal modular crowd control munition 10 comprises a support 20 fixed to a support platform 60. An explosive material 50 is fixed within the support 20 behind a pellet matrix 22 that contains soft pellets 40. Inserts 16, such as sheets of foam or other suitable material, are positioned on either side of the explosive material 50 to stabilize, ie., tightly pack to prevent shifting, dissipate some of the blast energy, and protect the explosive material 50. On detonation, the crowd control munition 10 propels the pellets 40 from the pellet matrix 22 through the forward part of the support 20, and into the crowd.

The support 20 comprises a hollow thermoplastic member with a front side 24 having a smooth front face and a curved or concave back side 26, with the front side 24 and back side 26 suitably attached, such as with a cyanoacrylate adhesive. The front side 24 preferably has a flush surface to increase ease of transport and use, with the front side 24 scored on its interior section to increase destruction of the front side 24 on detonation. For example, the interior section of the front side 24 may include milling the interior into fragmentation squares of from about 0.5 inch to about 1.25 inch. The curvature of the back 26 of the support 20 allows the support 20 to focus the blast of the explosive material 50 forward. The support 20 is attached to the support platform 60, which may non-exclusively include "legs" or an adhesive to fix the support 20 onto another object, such as a vehicle, tree, etc. Preferably, the support 20 also has markings or indicia 12 that distinguish the munition 10 as dangerous when mishandled or misused, but intended for non-lethal use. The markings and indicia 12 may include raised, colored or other noticeable representations, particularly those that are readily readable at night or during high tempo operations. The size and shape of the support 20 may vary to suit particular needs, such as particular size or shape limitations, with the proper dimensions of the support 20 being determinable by those skilled in the art for a given use in light of the disclosure herein. The size of the support 20 preferably ranges from about five inches to about ten inches in length 20L, and from about four inches to about eight inches in height 20H. More preferably, the support 20 ranges from about six inches to about eight inches in length 20L, and from about five inches to about seven inches in height 20H. A commercially available support 20 is sold by Mohawk Electric Systems of Milford, Del. under the tradename MCCM.

Within the support 20, the pellet matrix 22 is fixed. The support 20 houses and orientates the pellet matrix 22 for proper directional use. The pellet matrix 22 has a front and back that correspond to the front side 24 and back side 26 of the support 20, respectively. The pellet matrix 22 is comprised of a positioning member 18 containing compartments 28 for encasing the pellets 40 therein. Each compartment 28 within the pellet matrix 22 is substantially similar in shape and size with other compartments 28 within the pellet matrix 22, with each compartment 28 containing one or more pellets 40. Preferably no void area, i.e., compartments 28 without pellets 40, exist. The number of compartments 28 as a ratio to the number of pellets 40 within the pellet matrix 22 may vary to suit particular needs. Preferably, each compartment 28 contains a singular pellet 40. With each compartment containing a single pellet 40, the support 20 containing the plurality of pellets 40 has an equal number of pellets 40 and compartments 28. Manufacturing, use or other criteria may increase the average number of pellets 40 to compartment 28, to a ratio outside of 1:1 (pellet:compartment), such as from about 1.1:1; 1.2:1; 1.5:1; 2:1; 2.5:1; 3:1; etc, with the ratio of 1:1 (pellet to compartment) being most preferred.

The positioning member 18 of the pellet matrix 22 preferably comprises a low density thermoplastic wrap material that forms the compartments 28 for retaining the pellets 40. The pellets 40 are fixed or adhered in the positioning member 18 in any suitable manner as determinable by those skilled in the art, such as heat sealing. After adhesion with the pellets 40, the positioning member 18 preferably becomes a self-supporting member within the support 20. The size of the pellet matrix 22, i.e.,the positioning member 18 and pellets 40 therein, conforms to the interior of the support 20. The pellet matrix 22 preferably comprises a rectangular shape to correspond with the height and width of the interior of the support 20, with rows 34 across the length, and columns 36 across the height of a formed layer 38 of pellets 40 within the pellet matrix 22. The pellet matrix 22 preferably comprises a rectangular configuration having multiple layers 38. Each rectangular pellet matrix 22 comprises a suitable height and width for holding and firing the pellets 40 from within the support 20. A commercially available thermoplastic wrap material is sold by R & K Packaging of Salt Lake City, Utah under the tradename Tubing.

Preferably the pellet matrix 22 comprises from about 200 to about 1000 compartments with a singular pellet 40 in each compartment 28, more preferably from about 500 to about 700 compartments in multiple layers. The length of the pellet matrix 22 preferably extends from about 8.1 inches to about 8.3 inches in length and from about 3.3 inches to about 3.5 inches in height, ie., 8.2 inches by 3.4 inches. The thickness of the pellet matrix 22 has a maximum amount relative to the explosive material 50, with a maximum thickness of approximately 0.70 inch preferred. Most preferably, the pellet matrix 22 comprises approximately 600 pellets 40 positioned within 600 compartments 28 in the pellet matrix 22 having twelve rows 34 and twenty-five columns 36 for each layer 38 with two layers 38 of pellets 40. The compartments 28, with the pellets 40 therein, may be arranged within the pellet matrix 22 in any other suitable geometric arrangement for suitable for the dispersion of the pellets 40, such as having 600 pellets in thirty pellets 40 per row 34 and twenty pellets 40 per column 36, forming a singular layer 38. The pellet matrix 22 preferably comprises two layers 38 of compartments 28.

The pellets 40 of the modular crowd control munition 10 comprise a suitable soft material for minimizing injury to crowd members, ie., having sufficient deformation properties on impact. Additionally, the soft material retains sufficient resilience to maintain structural integrity to remain a substantially singular unit, ie., the pellet 40 remains as a single structure, when it receives the explosive force from the detonation of the explosive material 50. Preferably, the soft material comprises a rubber, plastic or other soft compositions, or combinations of soft compositions. Preferably, the soft material comprises plastic. Plastics include high density polyethylene, polyvinyl chloride (PVC) and other similar polymer compositions.

The soft pellets 40 comprise any suitably rounded shape to minimize injury to individuals within the crowd, with a substantially uniform sphere shape being most preferred for directional and momentum control of the pellets 40. The spherical pellets 40 comprise a suitable diameter for dispersion, such as from about 0.31 inch to about 0.33 inch, or from about 0.312 inch to about 0.32 inch. Additionally the spherical pellets 40 comprise a suitable mass for dispersion, such as from about 0.3 grams to about 0.5 grams or from about 0.3 grams to about 0.42 grams. The soft pellets 40 of the present invention are preferably doped with an appropriate composition, such as 5% barium sulfate, for x-ray detection and removal of the pellets 40 once the one or more pellets 40 have been lodged in a person's body. Other additives may be added to the soft pellets 40, as desired, provided that the pellets 40 are not changed by the additives into lethal objects. A commercially available soft pellet 40 is sold by Engineering Laboratories of Pompton Lakes, N.J. under the tradename MCCM Ball.

The soft pellets 40 are suitably fixed within the pellet matrix 22 of the crowd control munition 10 for retention therein prior to detonation of the explosive 50, and ejection therefrom during detonation of the explosive 50. Preferably the pellets 40 are retained in the pellet matrix 22 with an inert gelatin 32. The inert gelatin 32 comprises a suitably viscose or adhesive property to sufficiently retain the pellets 40 during handling prior to detonation. A preferred composition for the inert gelatin 32 comprises a propylene glycol, water and gum guar mixture, such as that sold by Binex Inc. of Murray, Utah under the tradename Gel. Although non-liquid pellet holders may be used, their use is not favored as they present additional debris from the crowd control munition 10 on detonation that may cause additional injury to people within the crowd.

The explosive material 50 is fixed within the support 20, between the back side 26 of the support 20 and the pellet matrix 22. The explosive material 50 comprises a low velocity explosive sheet material. Preferably the explosive comprises a pentaerythritol tetranitrate (PETN) component. PETN comprises a highly explosive organic compound belonging to the same chemical family as nitroglycerin, i.e., the nitric acid esters of polyalcohols. PETN is less sensitive than nitroglycerin and easily detonated. PETN is a colorless, crystalline material that may be fixed into, or onto, a sheet structure. Within the present invention, PETN is modified for low velocity use. The low velocity explosive material may comprise an entire sheet or sectionalized parts of the sheet, with the sheet having a suitable size and thickness for containing an appropriate amount of explosive material 50 for detonation, with the proper size and shape of the sheet, and the amount and composition of the explosive material 50 being determinable by those skilled in the art in light of the disclosure herein, with the sheet preferably being approximately 8 inches in length, approximately 3.5 inches in height, and approximately 0.042 inches deep. Preferably the sheet of low energy explosive material 50 comprises a substantially uniform thickness along and behind the pellet matrix 22. Detonation of the explosive material 50 may be accomplished by detonation methods known in the art. Fuses, ie., time delayed, switch, trip, contact or other detonation methods, may be used. Preferably fuses comprise blasting caps, i.e., non-electrical, to minimize hard objects within the crowd control munition 10 and to diminish chances of accidental detonations. Detonation methods that necessitate positioning non-crowd persons in front of, or in an exposed location behind the crowd control munition 10, are generally avoided. Preferably, a non-electric Modernized Demolition Initiator (MDI) is combined with a M81 igniter and XM17 shock tube to initiate the crowd control munition 10. A commercially available explosive material 50 is sold by Ensign-Bickford of Simsbury, Massachusetts under the tradename Primasheet. Preferred amounts of explosive material 50 range from about 12 grams to about 13 grams of PETN-based Primasheet, such as 12.5 grams of PETN-based Primasheet.

The crowd control munition 10 may include a sheddable covering 14, for protection during storage and handling, which is removed prior to detonation. In one preferred embodiment, the non-lethal modular crowd control munition 10 has a configuration of a Claymore munition styled device.

Figure 2:
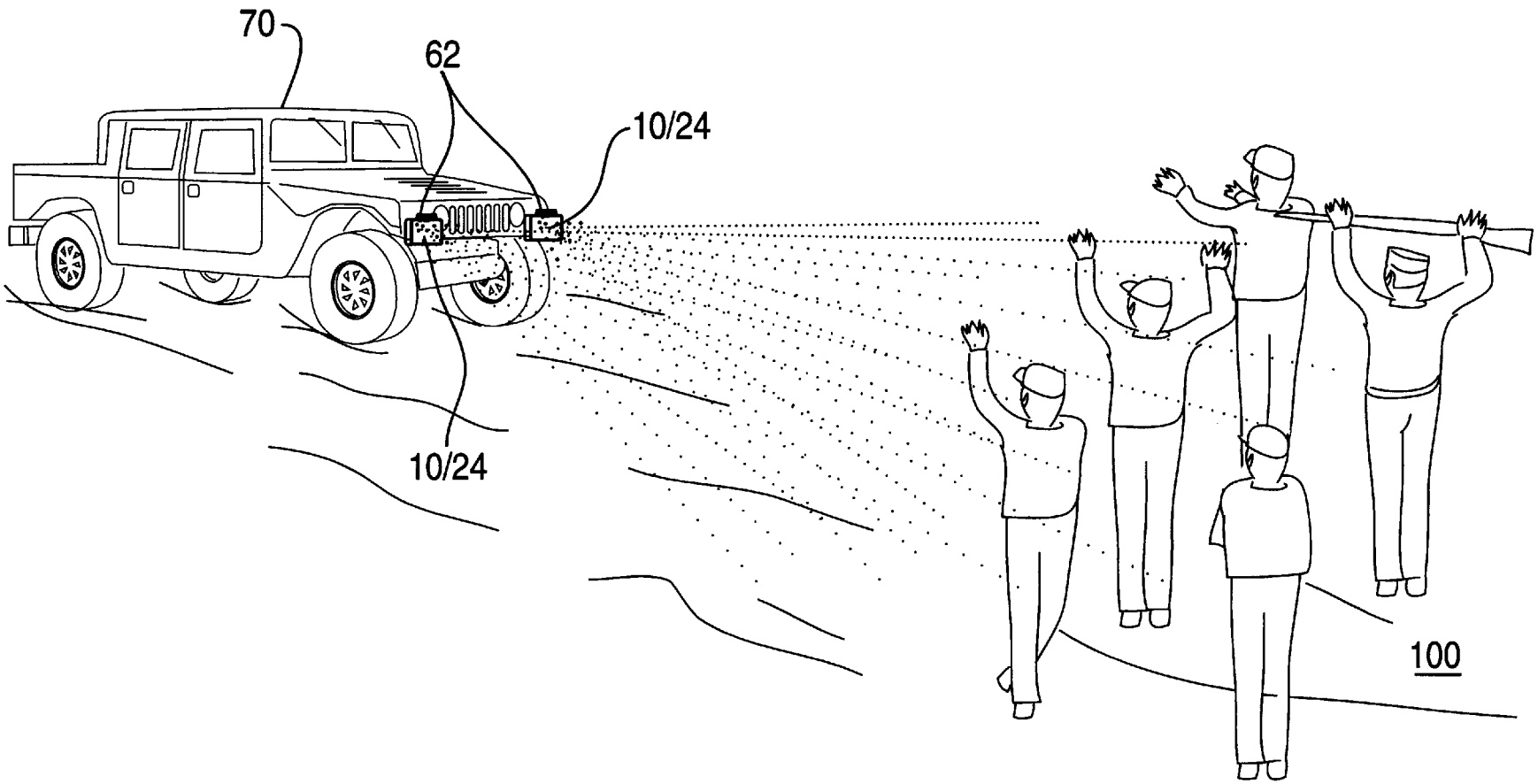

As shown in FIG. 2, the crowd control munition 10 may be mounted on any suitable platform 70, such as a vehicle, non-exclusively including tanks, trucks, or other transport, ships, or the ground or other fixed location, such as cargo boxes, buildings, hill tops and other land masses, trees, etc., for engaging the crowd 100. Selection of a proper location for the placement of the crowd control munition 10 is determinable by those skilled in the art, considering such factors as crowd size, movement and purpose, areas despot to be protected, number ratio of crowd to security force members, etc. The crowd control munition 10 is positioned to expose the crowd 100 to the front side 24. A reinforced structure 62 that is sufficient for withstanding the back-blast of the explosive material 50 on detonation is used adjacent to the back side 26 of the crowed control munition 10 for vehicle occupant protection. The crowd control munition 10 may be located at any suitable height for effectively dispersing the soft pellets 40 into the crowd 100. The height of the crowd control munition 10 preferably ranges from about two inches to about forty-eight inches, with a preferred height of from about four inches to about twenty-four inches. The crowd control munition 10 may be positioned to fire down onto the crowd 100 from a height greater than forty-eight inches, however, this increases the likelihood of injury to individuals in the crowd 100, particularly injuries to the ears and eyes.

In operation, once the crowd control munition 10 is detonated, the propelled soft pellets 40 attain a sufficient average maximum velocity to significantly discomfort and/or incapacitate individuals within the crowd 100. A preferred average velocity includes pellet speeds of from about 500 feet per second or less, with a more preferred average velocity of from about 200 feet per second to about 400 feet per second. The propelled soft pellets 40 have any suitable effective range for non-lethal crowd control, as determinable by those skilled in the art in light of the teachings herein, with a preferred average effective range of from about 5 meters to about 15 meters. Effective ranges of between from about 5 meters to about 15 meters infer that individuals positioned closer than five meter on detonation, on average, are at risk of serious injury or death, with individuals outside of a range of 15 meters being on average discomforted, but that significant discomfort causing incapacitation remains unlikely. At ranges of from about 60 feet to about 70 feet, the soft pellets fall to the ground. The crowd control munition 10 covers an arc, across the length 20L, of from about 60 degrees to about 70 degrees.

During detonation, the plurality of soft pellets 40 are propelled into critical zone or areas of the crowd 100 to interrupt mob action at particular, i.e., critical, locations or times. Examples of critical locations non-exclusively include the front or sides of trucks or other vehicle that are exposed to the crowd 100 in a manner that endangers the occupants thereon, comers or entrance ways of buildings containing individuals who are endangered by the outside mob action, alongside weapon storage areas for nuclear and related materials that are being invaded by overwhelming crowds, and other such locations that would otherwise warrant protection by deadly force. Critical times include disruption of mob activities at a time of military or police action, detonation during the timing of a mob controlled event, i.e., a dangerous situation anticipated by the crowd 100 at a particular time, and other such mob event disruptions. Whether used in a manner to disrupt the placement or timing of the crowd 100, the crowd control munition 10 projects pellets 40 in a non-lethal manner into zone of the crowd 100 to disrupt the organization of the crowd 100, and thereby interrupt the self-sustaining momentum found within the crowd 100.

EXAMPLE

Military forces entering an urban combat zone are confronted with large numbers of advancing civilians with rocks and other throwing objects obscuring well-armed opposing troops behind the crowd. Several crowd control devices are positioned by the entering military forces to maintain corridors through the on-coming civilians for the military forces to advance. Other crowd control devices are positioned to interrupt the movement of the mob in a manner that interferes with the ability of individuals within the mob to effectively harass the entering military forces. The entering military forces detonate the devices and disperse the civilians from zones in front of the entering military forces. The entering military forces advance through the open zones to engage the well-armed opposing troops. Once engaged with the well-armed opposing troops, the military forces resort to deadly force.

It should be understood that the foregoing summary, detailed description, example and drawings of the invention are not intended to be limiting, but are only exemplary of the inventive features which are defined in the claims.

What is claimed is:

1. A non-lethal modular crowd control munition, comprising:

a support having a front side and a back side defining a chamber therein;

a pellet matrix fixed within the defined chamber, the pellet matrix having a substantially uniform thickness and containing a plurality of compartments with each compartment being substantially similar in shape and size with other compartments;

a plurality of soft pellets fixed within the pellet matrix, wherein each compartment contains approximately an individual soft pellet therein; and, a low energy explosive sheet material located within the defined chamber and along the back side of the pellet matrix, the explosive sheet material having a thickness and composition sufficient to propel the plurality of soft pellets from the pellet matrix.

2. The non-lethal modular crowd control munition of claim 1, wherein the pellet matrix comprises multiple rows of a plurality of compartments.

3. The nonlethal modular crowd control munition of claim 1, wherein the pellet matrix comprises from about 200 to about 1000 compartments.

4. The non-lethal modular crowd control munition of claim 3, wherein the pellet matrix comprises from about 200 to about 700 compartments.

5. The non-lethal modular crowd control munition of claim 3, wherein the pellet matrix comprises from about 200 to about 1000 soft pellets.

6. The non-lethal modular crowd control munition of claim 1, wherein the soft pellets comprise a plastic composition.

7. The non-lethal modular crowd control munition of claim 1, wherein the soft pellets comprise substantially uniform spheres.

8. The non-lethal modular crowd control munition of claim 7, wherein the soft pellets comprise a diameter of from about 0.312 inch to about 0.32 inch.

9. The non-lethal modular crowd control munition of claim 1, wherein the soft pellets comprise a mass of from about 0.3 grams to about 0.42 grams.

10. The non-lethal modular crowd control munition of claim 1, wherein the soft pellets are doped with a barium sulfate composition.

11. The non-lethal modular crowd control munition of claim 1, wherein the soft pellets are fixed within the compartments with an inert gelatin.

12. The non-lethal modular crowd control munition of claim 11, wherein the inert gelatin comprises a propylene glycol, water and guar gum mixture.

13. The non-lethal modular crowd control munition of claim 1, wherein the low velocity explosive sheet material comprises PETN.

14. The non-lethal modular crowd control munition of claim 1, wherein the front side comprises a fragmentable scored interior.

15. The non-lethal modular crowd control munition of claim 1, further comprising a sheddable covering.

16. A vehicle mounted crowd control device comprising the non-lethal modular crowd control munition of claim 1.

17. A method for crowd control, comprising the steps of:

providing a non-lethal modular crowd control munition having a support with a front side and a back side defining a chamber therein, a pellet matrix fixed within the defined chamber, the pellet matrix having a substantially uniform thickness and containing a plurality of compartments with each compartment being substantially similar in shape and size with other compartments, a plurality of soft pellets fixed within the pellet matrix, wherein each compartment contains approximately an individual soft pellet therein and a low energy explosive sheet material located within the defined chamber and along the back side of the pellet matrix, the explosive sheet material having a thickness and composition sufficient to propel the plurality of soft pellets from the pellet matrix;

positioning the munition with the front side facing a crowd; and, detonating the low energy explosive, wherein the soft pellets are effectively propelled into the crowd.

18. The method of claim 17, wherein the propelled soft pellets attain an average maximum velocity of from about 500 feet per second or less.

19. The method of claim 17, wherein the propelled soft pellets having an average effective range of from about 5 meters to about 15 meters.

* * * * *